US008686930B2

(12) United States Patent
Kasai

(10) Patent No.: US 8,686,930 B2
(45) Date of Patent: Apr. 1, 2014

(54) ELECTRO-OPTICAL DEVICE HAVING ODD AND EVEN SCANNING LINES FOR ALTERNATELY DRIVING ODD AND EVEN COLUMN PIXELS AND METHOD FOR DRIVING THE SAME

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 359 days.

(21) Appl. No.: 12/752,538

(22) Filed: Apr. 1, 2010

(65) Prior Publication Data

US 2010/0253713 A1 Oct. 7, 2010

(30) Foreign Application Priority Data

Apr. 1, 2009 (JP) ..... 2009-089618

(51) Int. Cl.
*G09G 3/32* (2006.01)

(52) U.S. Cl.
USPC ..... 345/82

(58) Field of Classification Search
USPC ..... 345/76, 82; 315/169.3
See application file for complete search history.

(56) References Cited

U.S. PATENT DOCUMENTS

| | | | |
|---|---|---|---|
| 4,582,395 A | 4/1986 | Morozumi | |
| 5,714,968 A | 2/1998 | Ikeda | |
| 5,903,249 A | 5/1999 | Koyama et al. | |
| 5,940,053 A | 8/1999 | Ikeda | |
| 6,011,529 A | 1/2000 | Ikeda | |
| 6,765,560 B1 | 7/2004 | Ozawa | |
| 8,059,140 B2 | 11/2011 | Kwon et al. | |
| 2003/0117422 A1* | 6/2003 | Hiyama et al. | 345/690 |

(Continued)

FOREIGN PATENT DOCUMENTS

| | | |
|---|---|---|
| EP | 2 026 321 A1 | 2/2009 |
| JP | A-8-54835 | 2/1996 |
| JP | A-8-54836 | 2/1996 |
| JP | A-2000-122608 | 4/2000 |
| JP | A-2000-276109 | 10/2000 |
| JP | A-2007-212998 | 8/2007 |

OTHER PUBLICATIONS

European Search Report issued Feb. 18, 2011 for European Patent Application No. 10158539.6.

*Primary Examiner* — Long D Pham
(74) *Attorney, Agent, or Firm* — Oliff PLC

(57) ABSTRACT

An electro-optical device includes: a plurality of unit circuits arranged corresponding to crossings between a plurality of scanning lines and a plurality of data lines; a plurality of wirings that constitutes each of the plurality of scanning lines; a scanning line drive circuit that sequentially selects one of the scanning lines while sequentially selecting one of the wirings included in the scanning line, at every driving period within each unit circuit; and a data line drive circuit that, at every period within the each unit period which is a writing period before the drive period is started, outputs a data potential in response to the gradation data of the unit circuit, which corresponds to the wiring selected in the driving period within the unit period, to a data line corresponding to the unit circuit out of the each data line. Each of the plurality of unit circuits includes: an electric optical element that displays gradation in response to the data potential; a capacitative element having a first electrode connected to a capacitance line and a second electrode connected to the data line; and a switching element that is disposed between the second electrode and the electric optical element and, by being electrically conducted in selecting one of the wirings by the scanning line drive circuit, allows the second electrode and the electric optical element to be electrically conducted.

15 Claims, 11 Drawing Sheets

(56) References Cited

U.S. PATENT DOCUMENTS

2003/0227428 A1 12/2003 Nose
2006/0001634 A1* 1/2006 Lee et al. ..... 345/98
2006/0007215 A1* 1/2006 Tobita et al. ..... 345/204
2006/0267885 A1* 11/2006 Kwak et al. ..... 345/76
2008/0136795 A1* 6/2008 Numao et al. ..... 345/204
2008/0180422 A1* 7/2008 Kusafuka et al. ..... 345/204
2009/0195534 A1 8/2009 Kasai
2010/0053042 A1* 3/2010 Kajiyama et al. ..... 345/76

* cited by examiner

ELECTRO-OPTICAL DEVICE HAVING ODD AND EVEN SCANNING LINES FOR ALTERNATELY DRIVING ODD AND EVEN COLUMN PIXELS AND METHOD FOR DRIVING THE SAME

BACKGROUND

1. Technical Field

The present invention relates to an electro-optical device including an organic EL (electro luminescent) element, a liquid crystal a method for driving thereof, and electronic apparatus.

2. Related Art

In the past, an electro-optical device including organic EL elements as an electric optical element has been provided. The electro-optical device is provided with various drive circuits for supplying a predetermined current or voltage to the organic EL elements or the like. Such a drive circuit, for example, often includes capacitative elements connected in parallel with the organic EL elements. In this case, a data potential is supplied to the anode of the organic EL element and one electrode of the capacitative element, and a reference potential is supplied to the cathode of the organic EL element and the other electrode of the capacitative element. With this configuration, a current based on accumulated electric charges in the capacitative element, that is, data potential, can be performed to the organic EL element, so that stable drive or the like of the organic EL element can be performed.

As such an electro-optical device, a device disclosed in JP-A-2000-122608, for example, is known.

Meanwhile, the following problems exist in the above-described electro-optical device. Specifically, to make a light emission amount (a time integral value of light emission brightness) of the organic EL element become a sufficient value, a charge amount accumulated in the capacitative element needs to be increased. Therefore, it is necessary to make the capacitance of the capacitative element become a very large value. However, because a physical area allowed for each drive circuit is limited, it is difficult ever to realize such a large capacitance value.

Accordingly, in order to solve the problem, a technique is disclosed in U.S. Patent Application Publication No. 2009/0195534. In the technique, capacitative elements, each included in respective drive circuit (unit circuit), are used for driving one organic EL element. In a simple example, in the case where drive circuits are arranged in one line and the number of the circuits is N (therefore, the number of the capacitative elements and the number of the organic EL elements are both N), in driving one organic EL element, firstly, charging in response to data potential corresponding to the organic EL element is performed simultaneously to N-pieces of capacitative elements included in all drive circuits, and secondly, simultaneous discharging (more specifically, current supply) of the N-pieces of capacitative elements is performed to the organic EL element.

With this configuration, the above-mentioned inconvenience becomes negligible.

However, there is still a room for improvement in such a technique. Specifically, according to the above-mentioned example, simultaneous charging and simultaneous discharging to all of N-pieces of capacitative elements are performed to drive one organic EL element, and at each point of charging and discharging, an extremely large current may be generated instantaneously. Such a problem could be more serious as the number of capacitative elements or the number of drive circuits becomes larger. Therefore, if such large current may be generated, a problem occurs that noise associated with the current is generated, and as a result, properly controlled operation for all drive circuits becomes difficult, or adverse effect or the like to peripheral equipment due to the noise radiation will be concerned.

SUMMARY

An advantage of some aspects of the invention is to provide an electro-optical device, a driving method thereof and electronic apparatus capable of solving at least a part of the above-described problems.

Further, another advantage of some aspects of the invention is to provide an electro-optical device, a driving method thereof and electronic apparatus capable of solving problems related to the electro-optical device, the driving method thereof or the electronic apparatus in the above aspects.

The electro-optical device according to a first aspect of the invention, to solve the above-described problems, is equipped with a plurality of unit circuits arranged corresponding to crossings between a plurality of scanning lines and a plurality of data lines, a plurality of wirings that constitutes each of the plurality of scanning lines, a scanning line drive circuit that sequentially selects one of the scanning lines while sequentially selecting one of the wirings included in the scanning line, at every driving period within each unit circuit, and a data line drive circuit that, at every period within the each unit period which is a writing period before the drive period is started, outputs a data potential in response to the gradation data of the unit circuit, which corresponds to the wiring selected in the driving period within the unit period, to a data line corresponding to the unit circuit out of the each data line, in which each of the plurality of unit circuits includes an electric optical element that displays gradation in response to the data potential, a capacitative element having a first electrode connected to a capacitance line and a second electrode connected to the data line, and a switching element that is disposed between the second electrode and the electric optical element and, by being electrically conducted in selecting one of the wirings by the scanning line drive circuit, allows the second electrode and the electric optical element to be electrically conducted.

According to an aspect of the invention, the following operation can be realized, for example.

Specifically, firstly, in writing period, charging to the capacitative element in the unit circuit as described above, which is connected to a predetermined data line is performed. Herein, a capacitative element being a subject to be charged is limited to an element included in "the unit circuit corresponding to the wiring selected in a driving period". Secondly, in a driving period after the writing period, discharging of the capacitative element that became the subject to be charged first is performed to an electric optical element included in a unit circuit corresponding to one selected wiring.

In such an operation, the number of unit circuits involved in charging to the capacitative element and discharging from it becomes smaller compared to the number of all unit circuits. In short, according to an aspect of the invention, during a period when the above-mentioned first and second operations are performed once, capacitative elements in all unit circuits are not necessarily involved in such charging and discharging.

As described above, according to an aspect of the invention, the number of capacitative elements that become the subject of charging or discharging becomes smaller at least compared to the total number of capacitative elements, so that a risk that an extremely large current is instantaneously generated is really reduced. Therefore, according to an aspect of the invention, generation of noise can be suppressed, and generation of various inconvenience associated with the noise can be suppressed.

Meanwhile, according to an aspect of the invention, "the scanning line drive circuit" "sequentially selects one scanning line while sequentially selecting one wiring included in the scanning line" has the following meaning. That is to say, assuming that numbers 1, 2, 3, . . . are applied to scanning lines, α-1, α-2, . . . , α-β (herein, α is the number of the above-mentioned scanning line, β is an integer of 2 or more) are applied to β-pieces of wirings included in each of the scanning lines, the "sequentially selecting" means selecting each wiring in the order of 1-1, 1-2, . . . , 1-β, 2-1, 2-2, . . . , 2-β, 3-1, 3-2, . . . , 3-β, . . . .

Further, the electro-optical device according to a second aspect of the invention, to solve the above-described problems, is equipped with a plurality of unit circuits arranged corresponding to crossings between a plurality of scanning lines and a plurality of data lines; a plurality of wirings that constitutes each of the plurality of scanning lines; a scanning line drive circuit that sequentially selects one of the scanning lines while sequentially selecting one of the wirings included in the scanning line, at every driving period within each unit circuit; a data line drive circuit that, at every period within the each unit period which is a writing period before the drive period is started, outputs a data potential in response to the gradation data of the unit circuit, which corresponds to the wiring selected in the driving period within the unit period, to a data line corresponding to the unit circuit out of the each data line; and a plurality of first switching elements disposed between each of the plurality of data lines and the data line drive circuit, in which each of the plurality of unit circuits includes: an electric optical element that displays gradation in response to the data potential; and a second switching element that is disposed between the data line and the electric optical element and, by being electrically conducted in selecting one of the wirings by the scanning line drive circuit, allows the data line and the electric optical element to be electrically conducted, and when the data line drive circuit outputs the data potential to the data line, the first switching element corresponding to the data line enters an electrically conducting state in the writing period, to electrically conduct the data line with the data line drive circuit, by which charge in response to the data potential is accumulated in the capacitance attached to data line, and enters a non-conducting state in the driving period, to prevent the data line from being electrically conducted with the data line drive circuit.

According to an aspect of the invention, operational effect similar to the operational effect exerted by the above-described electro-optical device according to the first aspect of the invention is exerted.

However, according to an aspect of the invention, the subject to be charged is the "capacitance attached to the data line", and therefore, the subject to be discharged is also the "capacitance". Meanwhile, the discharging, based on the above-described provision, is realized by making the data line and data line drive circuit enter a non-conducting state in the driving period while the data line and the electric optical element enter an electrically conducting state.

Herein, the "capacitance attached to the data line" includes a parasitic capacitance in the data line itself (furthermore specifically, a parasitic capacitance or the like between the data line and one electrode that constitutes the electric optical element), for example. Further, the "capacitance attached to data line" also includes the "capacitative element" that constitutes the electro-optical device according to the first aspect of the invention mentioned above (therefore, in this regard, it can be concluded that the electro-optical device according to the second aspect has a wider capture range than the electro-optical device according to the first aspect).

As described above, according to an aspect of the invention, in addition to the operational effect exerted by the electro-optical device according to the first aspect, installation of the above-mentioned "capacitative element" is not an imperative factor, so that cost reduction required for installing the capacitative element can be achieved. Further, due to the same reason, size reduction of the unit circuit can be realized, higher definition is also made possible.

Meanwhile, meaning of "selection of scanning line" is the same as the above-described one.

The electro-optical device according to the first or second aspects of the invention may be constituted that the unit period for one unit circuit corresponding to one wiring included in the scanning line of one circuit out of the plurality of unit circuits overlaps at least a part of the unit period for another unit circuit corresponding to another wiring included in the scanning line.

According to this aspect, because unit time for one unit circuit partially overlaps unit time for another unit circuit, in a predetermined given time, it becomes possible to efficiently drive electric optical elements in all unit circuits.

Meanwhile, in this aspect, the "unit period according to unit circuit" means such period in a case where the output of the data potential and the selection of the scanning line which are performed in the above-mentioned writing period and driving period are executed for the unit circuit such that the electric optical element in the unit circuit reaches predetermined gradation.

Further, the electro-optical device according to the first or second aspects of the invention, the data line drive circuit may be constituted so as to include a switching section that determines to which data line out of the data lines the data potential should be supplied.

According to this aspect, since the data line drive circuit includes the switching section, to supply of data potential to each data line or the like is preferably performed, and as a result, the effect according to the invention mentioned above can be enjoyed more effectively.

Further, regarding this aspect, more specifically, if one scanning line includes "two" wirings, for example, two data lines that correspond to two unit circuits corresponding to each of the two wirings could be a data line to be switched by the switching section. Then, by this arrangement, during a writing period for one unit circuit out of the two, a data potential is supplied to one data line corresponding to it, and during a writing period for the other unit circuit, a data potential is supplied to the other data line corresponding to it. In this case, since the one data line is open in a way particularly during the latter writing period, the period can be applied to charge discharging from the capacitance attached to data line, more specifically, to a driving period for the one unit circuit. This means that, at least a part of "the driving period" and "the writing period" for each of the both unit circuits can be overlapped.

Consequently, according to this aspect, the effect according to the invention mentioned above is exerted more effectively.

Further, the electro-optical device according to the first or second aspect of the invention may be constituted that the data line drive circuit includes a plurality of data potential generating sections that generates the data potential corresponding to each of the plurality of data lines independently to each other.

According to this aspect, since the data line drive circuit includes an independent constitution that is a plurality of data potential generating sections corresponding to each data line, output of a data potential for one data line and output of a data potential for another data line can be performed in parallel, for example. This means that at least a part of "the writing period" for both unit circuits corresponding to the both data lines can be overlapped.

Meanwhile, in this aspect as well, overlapping at least a part of "the driving period" and "the writing period" for each of the both unit circuits, as described in a preceding aspect, can be similarly realized.

Consequently, according to this aspect, the effect according to the invention mentioned above is exerted more effectively.

Further, in the electro-optical device according to the first or second aspect of the invention, it further includes an auxiliary capacitative element whose one electrode is connected to the data line other than the capacitative element in the each unit circuit or capacitance attached to the data line, may be constituted.

According to this aspect, even in a case where total capacitance of each capacitative element connected to a data line corresponding to the unit circuit or capacitance attached to the data line is small, comparing to capacitance necessary to make a light emission amount of an electric optical element in a selected unit circuit corresponding to a wiring included in the scanning line, shortage can be compensated by the capacitance of an auxiliary capacitative element.

Further, in the electro-optical device according to the first or second aspect of the invention may be constituted that a unit circuit corresponding to one wiring out of the plurality of wirings included in one of the scanning lines and a unit circuit that is adjacent to the unit circuit along the extending direction of the scanning line and corresponds to another wiring out of the plurality of wirings constitute one unit circuit group, and the unit circuit group is repeatedly arrayed along the extending direction of the scanning line, According to this aspect, as a simple example, on the premise that the scanning line includes two wirings of the first and second wirings, when attention is paid to one scanning line, repetitive array along with the line that a unit circuit corresponding to a first wiring, a unit circuit corresponding to a second wiring, a unit circuit corresponding to the first wiring, and so on is performed.

In such a case, since unit circuits being the subject of writing and driving are distributed for the array of all unit circuits with good balance, image display or the like can be performed more preferably.

Meanwhile, it goes without saying that this aspect is not limited to a case where the scanning line includes two wirings as in the same manner of the invention in general.

Further, electronic apparatus of the invention, to solve the problems, is equipped with the above-described various electro-optical devices.

Since the electronic apparatus of the invention is equipped with the above-described various electro-optical devices, generation of large current is avoided in simultaneous charging to capacitative element or capacitance attached to the wiring or simultaneous discharging from it, and as a result, it becomes possible to display a higher-quality image.

On the other hand, the driving method of an electro-optical device according to the first aspect of the invention, to solve the problems, is a driving method of an electro-optical device that includes an electric optical element, which is equipped with a plurality of wirings that constitute a scanning line and a plurality of unit circuits corresponding to each of the wirings, and reaches predetermined gradation by charge discharging from a capacitative element in the unit circuit, in which the method includes: a first process for supplying a first data potential only to a data line that corresponds to the unit circuit corresponding to one wiring out of the each wiring to accumulate charge in response to the first data potential in the capacitative element connected to the data line; a second process for making a switching element between the capacitative element and the electric optical element in the unit circuit corresponding to the one wiring enter an electrically conducting state by selecting the one wiring; a third process for supplying the second data potential only to a data line corresponding to the unit circuit that corresponds to another wiring out of the each wiring to accumulate charge in response to the second data potential in the capacitative element connected to the data line; and a fourth process for making a switching element between the capacitative element and the electric optical element in the unit circuit corresponding to the another wiring enter an electrically conducting state by selecting the another wiring.

According to an aspect of the invention, in the first and second processes, the capacitative element involved in charging to capacitative element and discharging from it is limited to an element connected to "a data line corresponding to the unit circuit that corresponds to one wiring". In short, since the invention is on the premise that a capacitative element included in "a unit circuit corresponding to another wiring" exists, all capacitative elements are not involved in such charging and discharging. The same applies to the third and fourth processes related to "another wiring".

As described above, according to an aspect of the invention, since the number of capacitative elements being a subject of charging or discharging becomes smaller than at least the total number of capacitative elements, a risk that extremely large current is instantaneously generated is really reduced. Therefore, according to an aspect of the invention, noise generation can be suppressed, and generation of various inconveniences associated with it can be suppressed.

Further, as it is obvious from according to an aspect of the invention, it becomes possible to preferably drive an electro-optical device according to the above-described invention.

Note that, in the invention, there may be a plurality of capacitative elements in the case where "capacitative element connected to data line".

Further, the driving method of an electro-optical device according to the second aspect of the invention, to solve the above-described problems, is a driving method of an electro-optical device equipped with a plurality of wirings that constitute scanning lines and a plurality of unit circuits corresponding to each of the wirings, and including an electric optical element that reaches predetermined gradation by charge discharging from capacitance attached to a data line extending so as to cross the scanning line, in which the method includes: a first process for supplying a first data potential only to the data line corresponding to the unit circuit corresponding to one wiring out of the each wiring to accumulate charge in response to the first data potential in the capacitance attached to the data line; a second process for making a switching element between the electric optical element and the data line in the unit circuit corresponding to the one wiring enter an electrically conducting state by selecting the one wiring; a third process for supplying a second data potential only to a data line corresponding to the unit circuit that corresponds to another wiring out of the each wiring to accumulate charge in response to the second data potential in the capacitance attached to the data line; and a fourth process for making a switching element between the electric optical element and the data line in the unit circuit corresponding to the another wiring enter an electrically conducting state by selecting the another wiring.

According to an aspect of the invention, operational effect similar to the operational effect exerted by the driving method of an electro-optical device according to the first aspect of the above-described invention is exerted. Note that, meaning of "capacitance attached to data line" mentioned in the invention is the same as the above-described one.

The driving method of an electro-optical device according to the first or second aspects of the invention may be constituted that the first process is performed in parallel with at least one process of the third and fourth processes, or the third process is performed in parallel with at least one process of the first and second processes.

According to this aspect, for example, implementation of the first process and the fourth process partially overlaps with each other, it becomes possible to efficiently drive electric optical elements in all unit circuits in a predetermined given time.

BRIEF DESCRIPTION OF THE DRAWINGS

The invention will be described with reference to the accompanying drawings, wherein like numbers reference like elements.

DETAILED DESCRIPTION OF EMBODIMENTS

In the following, a first embodiment according to an aspect of the invention will be explained referring to FIG. 1 and FIG. 2. Meanwhile, in each drawing that is referred to below in addition to FIG. 1 and FIG. 2 mentioned here, there are cases where ratio of dimensions between each section is made appropriately different from actual ratio.

Figure 1:
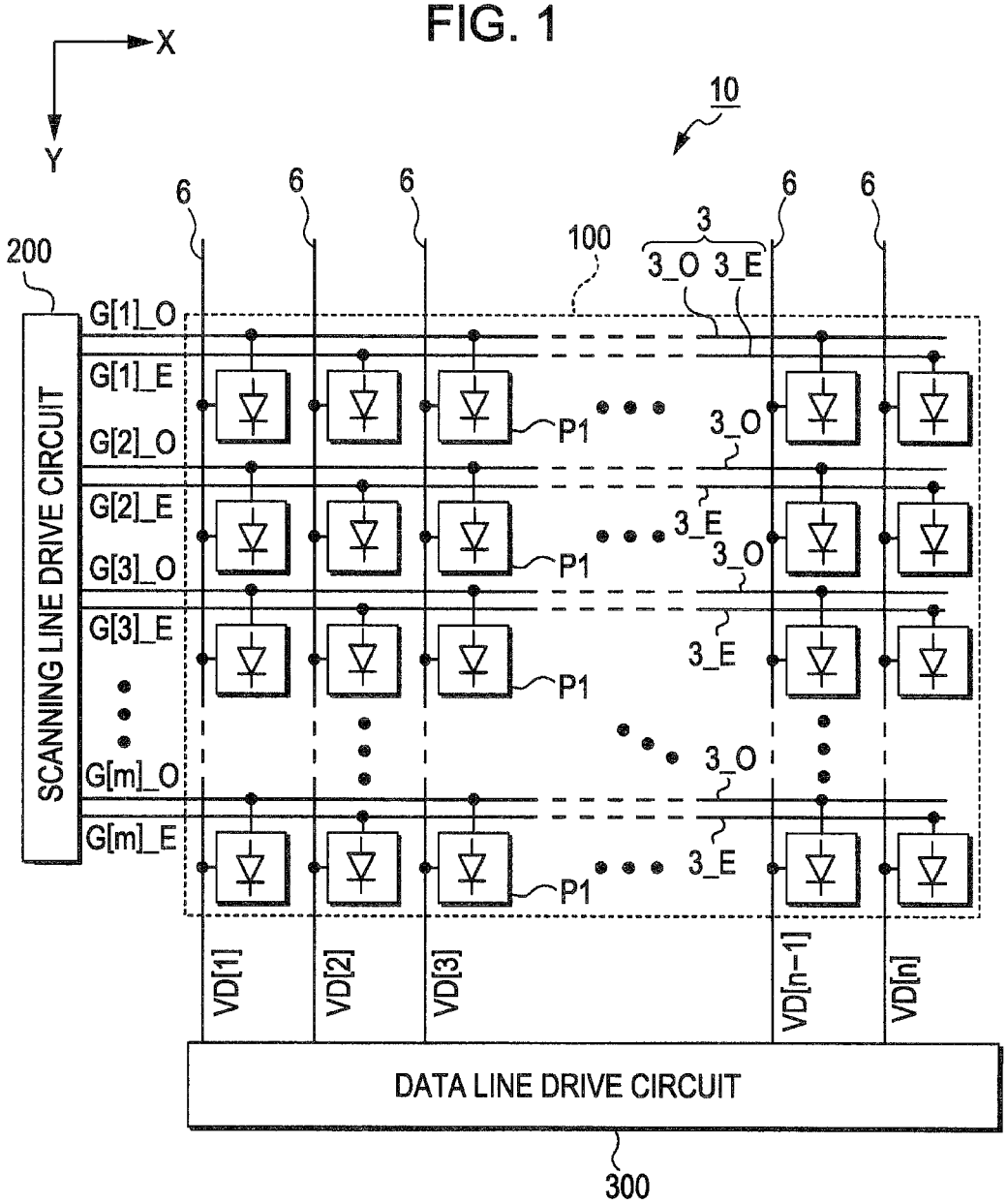
FIG. 1 is a block diagram showing an electro-optical device according to a first embodiment of the invention.

In FIG. 1, the electro-optical device 10 is a device that is employed by various electronic apparatus as an apparatus for displaying an image, and has a pixel array section 100, where a plurality of unit circuits P1 are arrayed in a sheet, a scanning line drive circuit 200 and a data line drive circuit 300. Note that, in FIG. 1, the scanning line drive circuit 200 and the data line drive circuit 300 are illustrated as individual circuits, but a constitution where a part or all of the circuits are formed in a single circuit is also employed.

As shown in FIG. 1, m-pieces of scanning lines 3 extending in the X-direction and n-pieces of data lines 6 (m and n are natural numbers) extending in the Y-direction orthogonal to the X-direction are provided for the pixel array section 100. Each unit circuit P1 is arranged at positions corresponding to crossings between the scanning lines 3 and the data lines 6. Therefore, these unit circuits P1 are arrayed in a matrix state of vertical m-rows×horizontal n-columns.

Of the constitutions above, m-pieces of the scanning lines 3 severally include one set of two wirings 3_O and 3_E as shown in FIG. 1. In short, when the scanning lines 3 are m-pieces, the total number of wirings 3_O and 3_E is 2m-pieces. Further, of these wiring 3_O and 3_E, the wiring 3_O is connected to unit circuits P1 positioned on an odd-numbered column, and on the other hand, the wiring LE is connected to unit circuits P1 positioned on an even-numbered column.

The scanning line drive circuit 200 shown in FIG. 1 is a circuit for selecting a plurality of unit circuits P1. The scanning line drive circuit 200 creates scan signals G[1]_O to G[m]_E which sequentially become active, and outputs the signals to each of 2m pieces of the wiring 3_O and 3_E which constitute the above-mentioned scanning lines 3. Of the scan signal G[i] supplied to the scanning line 3 of an i-th row (i is an integer that satisfies $1 \leq i \leq m$), transition of the scan signal G[i]_O into an active state means selection of (n/2)-pieces of the unit circuits P1 that belong to the i-th row and odd-numbered column, and transition of the scan signal G[i]_E to an active state means selection of (n/2)-pieces of the unit circuits P1 that belong to the i-th row and even-numbered column.

The data line drive circuit 300 shown in FIG. 1 creates data potentials VD[1] to VD[n] in response to the gradation data of each of (n/2) pieces of the unit circuits P1 corresponding to the wirings 3_O or 3_E which are selected by the scanning line drive circuit 200, and outputs the potentials to each data line 6. Meanwhile, in the following, data potentials VD output to the data line 6 on the j-th column (j is an integer satisfying $1 \leq j \leq n$) may be indicated as VD[j].

In this case, because each scanning line 3 includes two wirings 3_O and 3_E as mentioned above, each of the data potentials VD[1] to VD[n] is also supplied in response to selection or non-selection of the two wirings 3_O or 3_E. Specifically, for example, in response to selection of the wiring 3_O that constitutes the scanning line 3 on the first row, data potentials VD[1], VD[3], . . . , VD[2k−1], . . . (k is an appropriate integer, but 2k−1≤n) for unit circuits P1 that are positioned on odd-numbered columns are output to each data line 6. In response to selection of the wiring 3_E, data potentials VD[2], VD[4], . . . , VD[2k], . . . for unit circuits P1 that are positioned on even-numbered columns are output to each data line 6, and so on (refer to FIG. 1).

Figure 2:
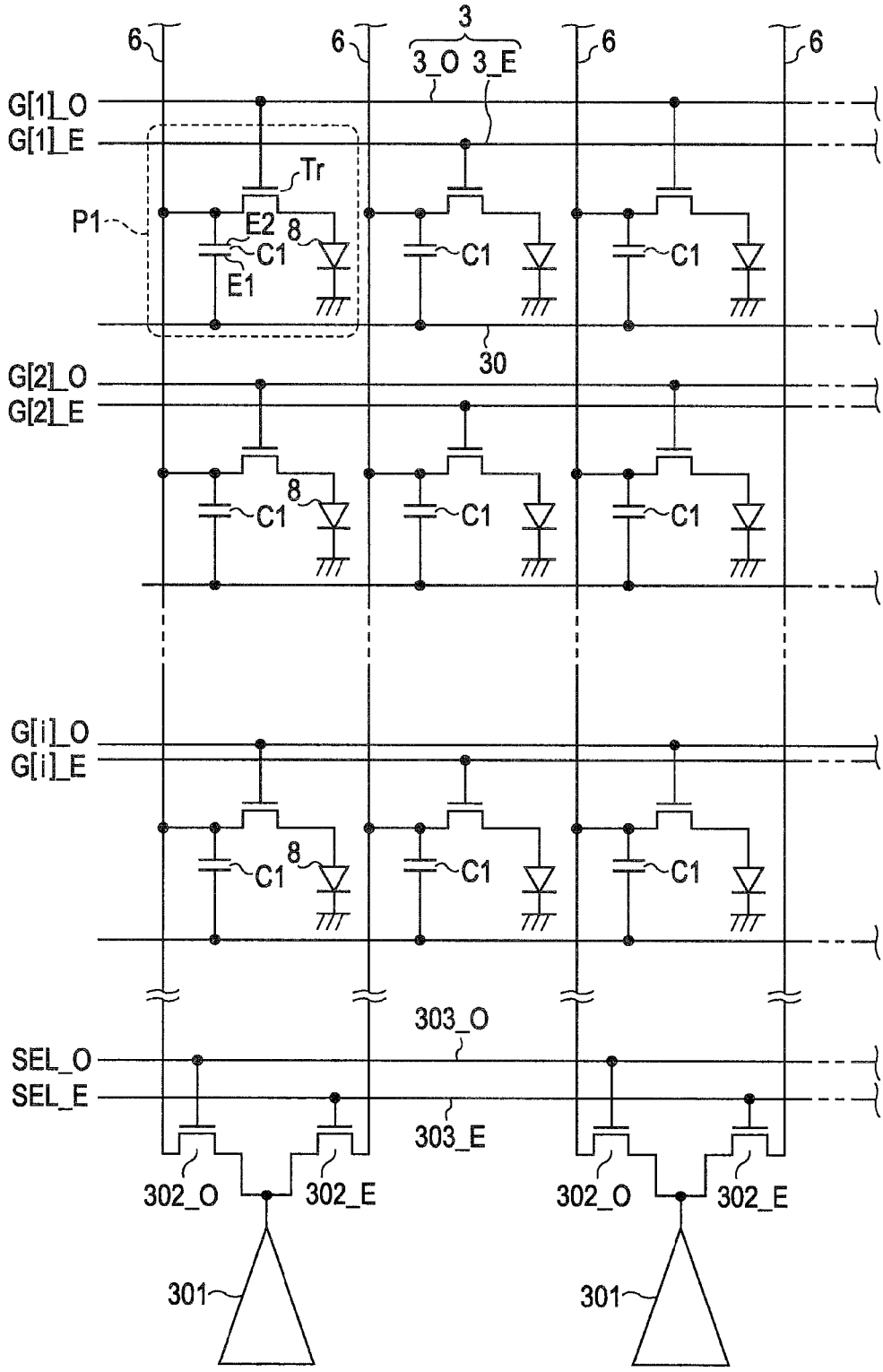
FIG. 2 is a circuit diagram showing details around unit circuits and data potential generating sections that constitute the electro-optical device in FIG. 1.

The data line drive circuit 300, to realize the above described, as shown in FIG. 2, includes data potential generating sections 301 supporting every 2 columns of the unit circuits P1, first and second switching transistors 302_O and 302_E, and wirings for controlling switching transistor (hereinafter, abbreviated as "wiring for SW") 303_O and 303_E which supply a control signal to each gate of the transistors.

Of these parts, the data potential generating sections 301 are provided such that one section supports every two data lines 6. Each of the data potential generating sections 301 generates a data potential in response to on which column in the pixel array section 100 two data lines 6 corresponding to the section are positioned. For example, the data potential generating section 301 shown on the far left side in FIG. 2 generates data potential VD[1] and VD[2].

Further, control signals SEL_O and SEL_E are output to the wiring for SW 303_O and 303_E respectively. The control signals SEL_O and SEL_E transit between the active state and non-active state similarly while appropriately synchronizing with transition of the scan signals G[1]_O to G[m]_E between each active state and non-active state.

Each of the first and second switching transistors 302_O and 302_E is an N-channel type, and enters the electrically conducting state when the control signals SEL_O and SEL_E enter the active state. Then, in response to the transition of each transistor (302_O, 302_E) between the electrically conducting and non-conducting states, a data potential VD[j−1] is output to the data line 6 of the (j−1)th column in some cases, and a data potential VD[j] is output to the data line 6 of the (j)th column in other cases.

FIG. 2 is a circuit diagram showing a detail electrical constitution regarding each unit circuit P1.

Each unit circuit P1, as shown in FIG. 2, has an electric optical element 8, a capacitative element C1 and a transistor Tr.

The electric optical element 8 is an OLED (Organic Light Emitting Diode) element where a light-emitting layer of an organic EL material is interposed between an anode and a cathode, as shown in FIG. 2, is arranged between the transistor Tr and a constant potential line (grounding wire) to which constant potential is supplied. Herein, the anode is an individual electrode that is provided by each unit circuit P1 and controlled by each unit circuit P1, and the cathode is a common electrode that is commonly provided for the unit circuit P1. Then, the cathode is connected to a constant potential line to which constant potential is supplied. Note that, the anode may be a common electrode and the cathode may be an individual electrode.

The capacitative element C1 is an element for holding the data potential VD[j] supplied from the data line 6. As shown in FIG. 2, the capacitative element C1 has a first electrode E1 connected to a capacitance line 30 and a second electrode E2 connected to the data line 6.

Meanwhile, the capacitance line 30 to which a fixed potential is supplied is commonly connected to each unit circuit P1. Further, grounding potential is supplied to a constant potential line. For example, a negative potential is supplied to the constant potential line, and data potential VD[n] showing the highest brightness, out of the data potential VD[j], may be a positive potential and the data potential VD[1] showing the lowest brightness, out of the data potential VD[j], may be a negative potential. More specifically, grounding potential may exist between the data potential VD[n] and the data potential VD[1]. With this arrangement, amplitude of the data potential VD[j] to the grounding potential can be reduced, and lower power consumption can be achieved.

The transistor Tr is an N-channel type, and is a switching element that electrically conducts a second electrode E2 of the capacitative element C1 with the electric optical element 8 by being electrically conducted in selecting a scanning line 3. As shown in FIG. 2, the source of the transistor Tr is connected to the anode of the electric optical element 8, and its drain is connected to the second electrode E2 of the capacitative element C1.

Then, the gate of the transistor Tr is connected to the scanning line 3. Herein, in the case where the gate of the transistor Tr is connected to the scanning line 3, the first embodiment has the following characteristics. Specifically, as shown in FIG. 2, the gate of the transistor Tr included in a unit circuit P1 positioned on an odd-numbered column is connected to a wiring 3_O that constitutes the scanning line 3. On the other hand, the gate of the transistor Tr included in a unit circuit P1 positioned on an even-numbered column is connected to a wiring 3_E that constitutes the scanning line 3.

Thus, as the scan signal G[i]_O transits to the active state, transistors Tr that belong to the odd-numbered column enter an On state, and the second electrode E2 and the electric optical element 8 are electrically conducted. On the other hand, as the scan signal G[i]_O transits to a non-active state, transistors Tr enter an Off state, and the second electrode E2 and the electric optical element 8 enter a non-conducting state. The same applies to the scan signal G[i]_E.

Next, the operation and action of the electro-optical device 10 according to the first embodiment will be explained referring to each drawing of FIG. 3 to FIG. 5 in addition to FIG. 1 and FIG. 2 which were already referred to.

The electro-optical device 10 has basic operations i and ii below.

i. Writing Operation

This writing operation is an operation to allow a capacitative element C1 in a unit circuit P1 that belongs to a column including an electric optical element 8, which is included in each unit circuit P1 corresponding to a wiring 3_O or 3_E, to hold the data potential VD[j] corresponding to the light emission gradation of the electric optical element 8. For example, the data potential VD[3] of a electro-optical device 8 that corresponds to the wiring 3_E included in the scanning line 3 of the second row and positioned on the third column (refer to FIG. 1) will be held by a plurality of the capacitative elements C1 in each unit circuit P1 positioned on the third column.

ii. Light-Emitting Operation (Driving of Electric Optical Element)

This light-emitting operation is an operation to allow the electric optical element 8 to perform light emission based on the data potential VD[j] held by the capacitative elements C1 in i. This operation includes supplying an active scan signal G[i]_O or G[i]_E to the wiring 3_O or corresponding to the unit circuit P1 including the electric optical element 8 and making the transistor Tr in the unit circuit P1 enter the electrically conducting state. Thus, the electric optical element 8 is supplied with a current in response to charge accumulated in the capacitative elements C1, and emits light.

The electro-optical device 10 of the first embodiment is basically operated based on an appropriate combination of the above-described i and ii, and more details on these points are as follows.

Figure 3:
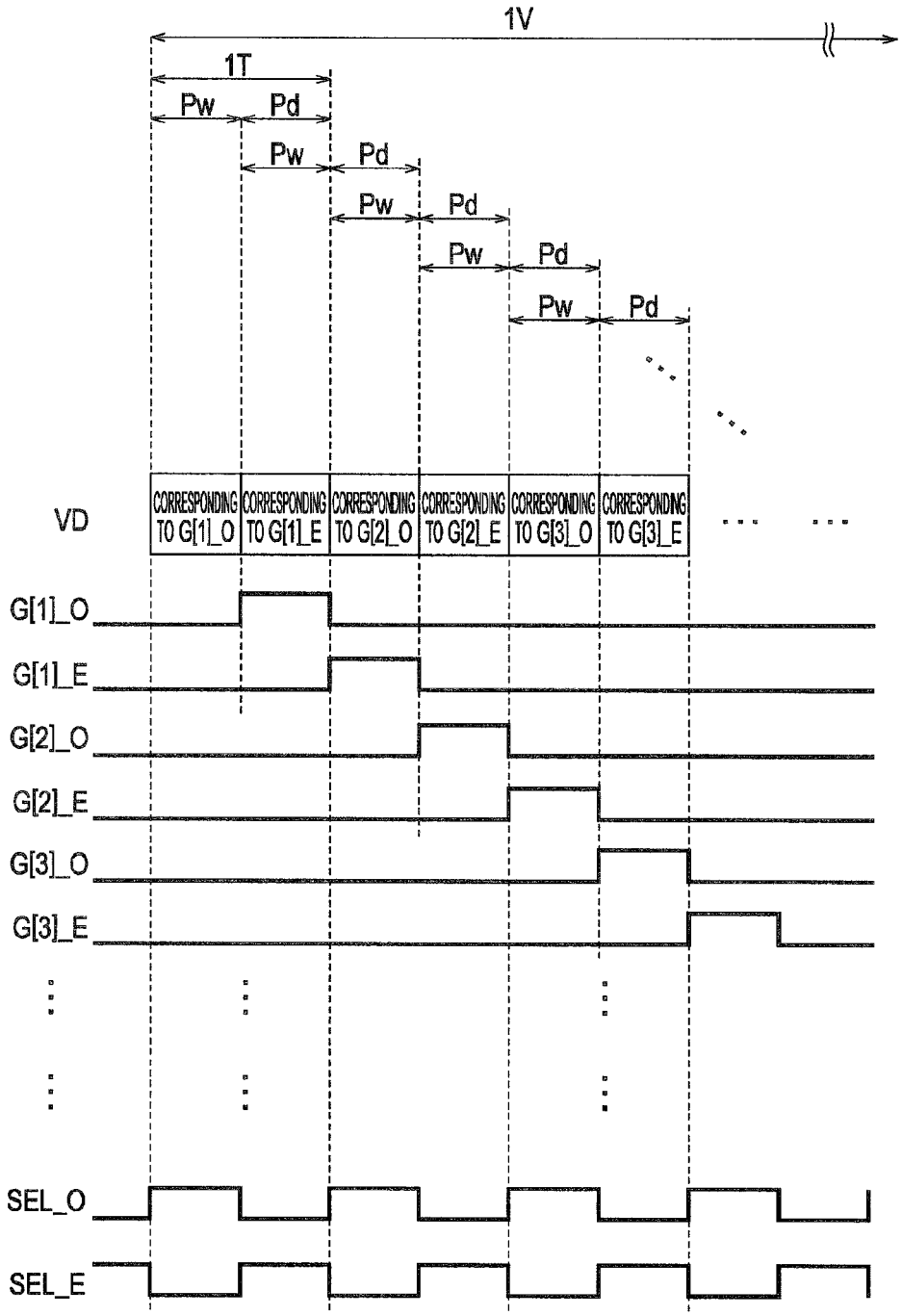
FIG. 3 is a timing chart for explaining an operation of the electro-optical device in FIG. 1 and FIG. 2.

Firstly, in a writing period Pw shown on the far left side in FIG. 3, supplying an active-state control signal SEL_O to a wiring for SW 303_O in the data line drive circuit 300 and supplying a non-active-state control signal SEL_E to a wiring for SW 303_E allow a first switching transistor 302_O to enter the On state and a second switching transistor 302_E to enter the Off state. Then, a data potential generating section 301 creates data potentials VD[1], VD[3], VD[2k−1], . . . , and supplies this to each data line 6 positioned on a corresponding odd-numbered column. The data potential VD[2k−1] corresponds to the electric optical element 8 in each unit circuit P1 positioned on the first row and the odd-numbered column (in FIG. 3, refer to a note "Corresponding to G[1]_O").

As described above, the i. writing operation for the electric optical element 8 in each unit circuit P1 that is positioned on the first row and the odd-numbered column is ended. Therefore, in this writing period Pw, only half the capacitative element C1 of all the capacitative elements C1 in the pixel array section 100 are involved in charging, and a plurality of the capacitative elements C1 that severally belong to each of the first column, third column, . . . , (2k−1)th column, . . . accumulate charge in response to the data potentials VD[1], VD[3], . . . , VD[2k−1], . . . .

Subsequently, in a driving period Pd adjacent to the writing period Pw, the scanning line drive circuit 200 supplies an active-state scan signal G[1]_O to the wiring 3_O included in the scanning line 3 on the first row. Thus, the electric optical element 8 corresponding to the wiring 3_O simultaneously emits light (the ii. light-emitting operation). In this case, a current that flows in the electric optical element 8 corresponds to a charge amount accumulated in the above-mentioned plurality of the capacitative elements C1. The above ends one unit period 1T (refer to top areas of FIG. 3).

Further, in the first embodiment, i. writing operation for the electric optical element 8 in each unit circuit P1 positioned on the first row and the even-numbered column is performed in parallel with this. Although the essence of an operation in this case is not different from the case of the above-mentioned writing operation, contrary to the above-described case, the control signal SEL_O becomes non-active and the control signal SEL_E becomes active, the first switching transistor 302_O enters the Off state and the second switching transistor 302_E enters the On state. Further, data potential generating section 301 creates potential VD[2], VD[4], . . . , VD[2k], . . . , and supplies it to each data line 6 positioned on a corresponding even-numbered column (in FIG. 3, refer to a language "Corresponding to G[1]_E"). Consequently, a plurality of the capacitative elements C1 that belongs to each of the second column, fourth column, . . . , (2k)th column, . . . accumulate charge in response to the data potential VD[2], VD[4], . . . , VD[2k], . . . .

Figure 4:
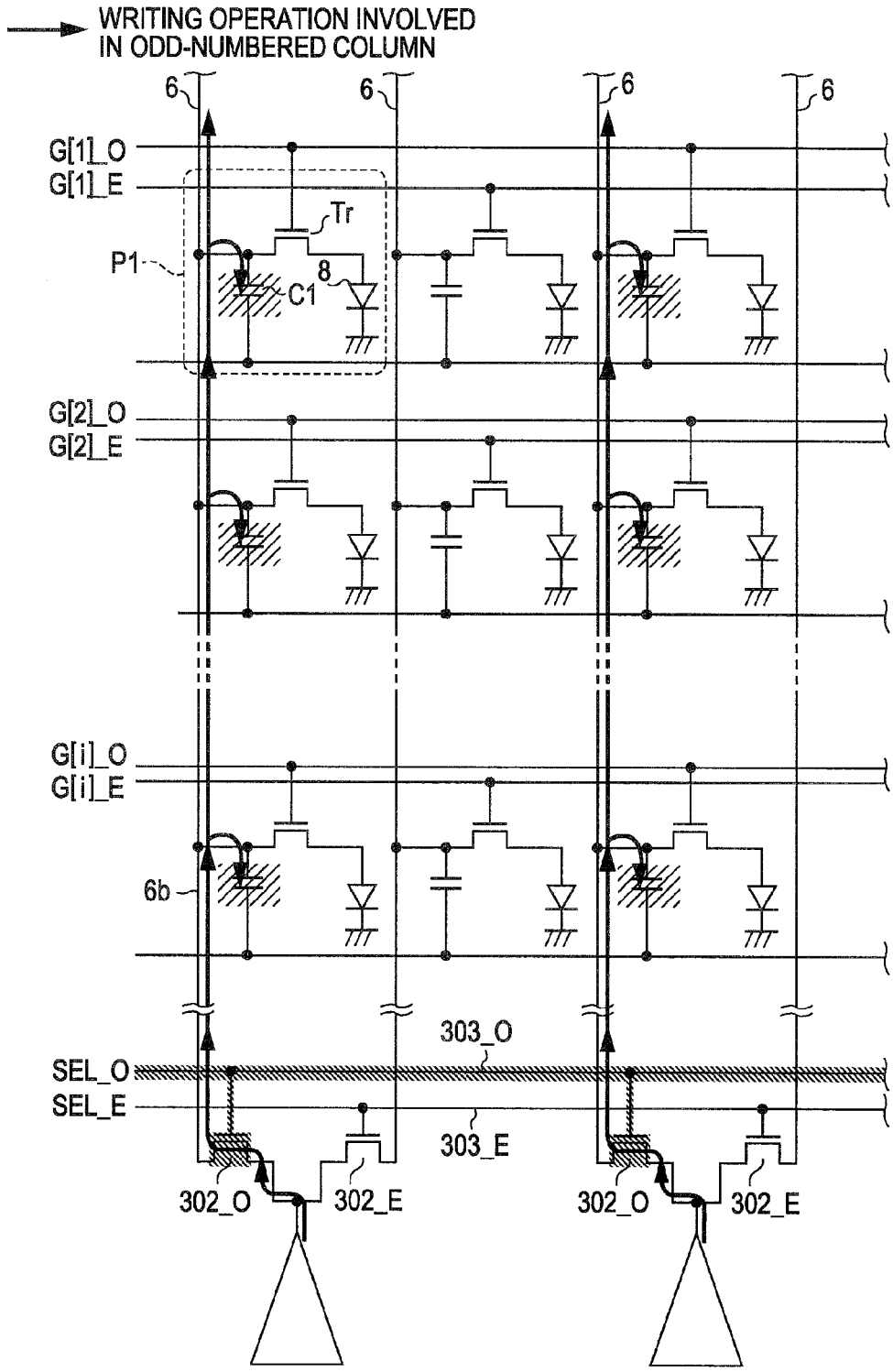
FIG. 4 is an explanatory view (1) visually expressing charging and discharging to/from a capacitative element (C1) in an electro-optical device that operates based on FIG. 3.
Figure 5:
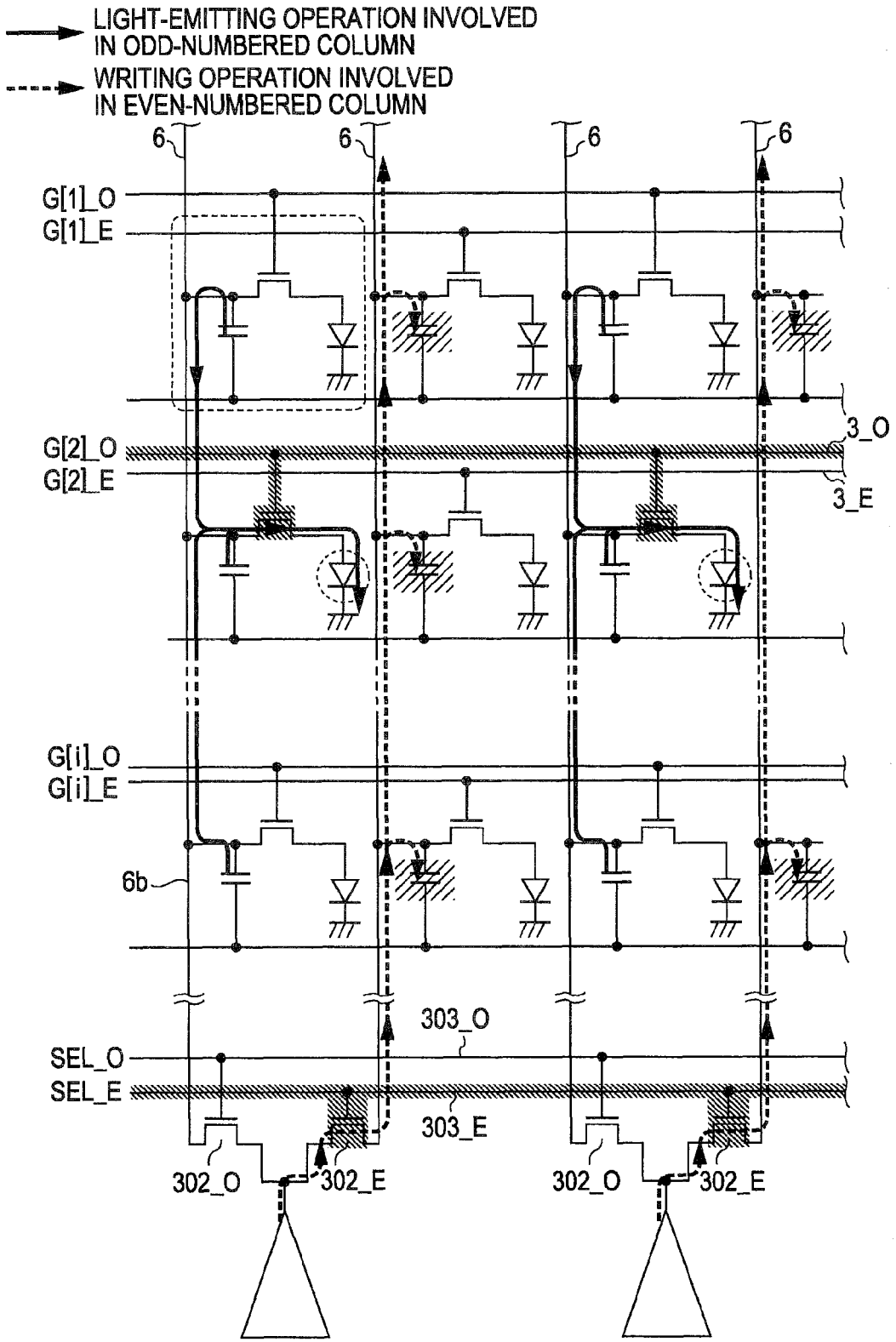
FIG. 5 an explanatory view (2) visually expressing charging and discharging to/from the capacitative element (C1) in an electro-optical device that operates based on FIG. 3.

FIG. 4 and FIG. 5 visually express the operations above. Specifically, in FIG. 4, a case is depicted where the control signal SEL_O becomes active, the first switching transistor 302_O enters an electrically conducting state, a plurality of the capacitative elements C1 on the (2k−1)th column, more specifically, the elements that belong to each of the odd-numbered column accumulate charge in response to the data potential VD[2k−1] (in FIG. 4, refer to bold and solid line arrows, and hatching portion related to them, or the like).

In FIG. 5, a case is depicted where the active-state scan signal G[2]_O is supplied to the wiring 3_O included in the scanning line 3 on the second row to allow transistors Tr that belong to the wiring 3_O to enter the On state, and each of the electric optical elements 8 corresponding to the transistors emits light. Further, in this occasion, a case is also depicted where a current is supplied to the electric optical element 8 in response to charge of a plurality of the capacitative elements C1 that belongs to the above-mentioned each column (in FIG. 5, refer to bold and solid line arrows, and hatching portion related to them, or the like).

On the other hand, in FIG. 5, a case is also depicted where the writing operation for the electric optical element 8 in a unit circuit P1 positioned on the (2k)th column, more specifically, an even-numbered column is performed in parallel with this (in FIG. 5, refer to bold and dashed line arrows, and hatching portion related to them, or the like). In the case of FIG. 5, since the electric optical element 8 on the second row and the wiring 3_O is a subject to be driven, and after FIG. 5, the electric optical element 8 on the second row and the wiring 3_E becomes subject to be driven to emit light (this is not shown).

After this, the above-described operation is performed repeatedly. Specifically, at any given point, a writing operation for the capacitative element C1 that belongs to an odd-numbered column and a light-emitting operation of the electric optical element 8 that belongs to an even-numbered column are performed. At another point, the electric optical element 8 being a subject of light emission will shift sequentially downward while the opposite operation is performed in FIG. 4 and FIG. 5 (or in FIG. 1 and FIG. 2).

Meanwhile, a period IV shown in FIG. 3 means one vertical scan period that is a period in which selection of scanning line passes through for all scanning lines 3 (more specifically, all of the wirings 3_O and 3_E).

The electro-optical device 10 of the first embodiment, which has such a constitution and performs operation, gives the following effect.

Specifically, according to the electro-optical device 10 of the first embodiment, each scanning line 3 includes two wirings 3_O and 3_E, and each of the wiring 3_O and 3_E is connected to unit circuits P1 positioned on the odd-numbered column and even-numbered column, so that the number of the capacitative elements C1 involved in simultaneous charging or simultaneous discharging in order to drive one electric optical element 8 is half the all capacitative elements C1, and a risk that extremely large current is instantaneously generated is extremely reduced even in each point of charging and discharging.

Figure 6:
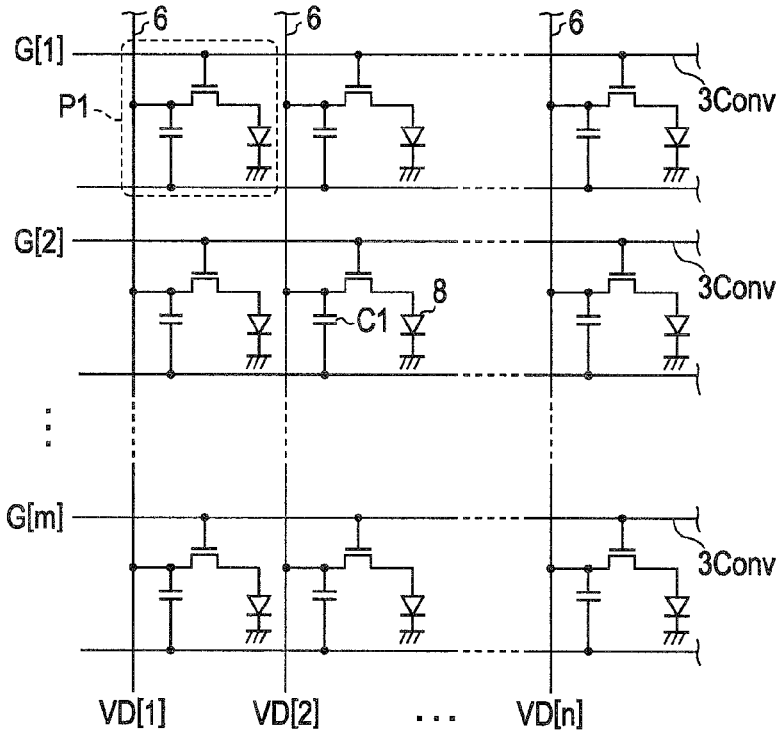
FIG. 6 is a view showing a constitution of a comparative example relative to the constitution of the electro-optical device according to the first embodiment.
Figure 7:
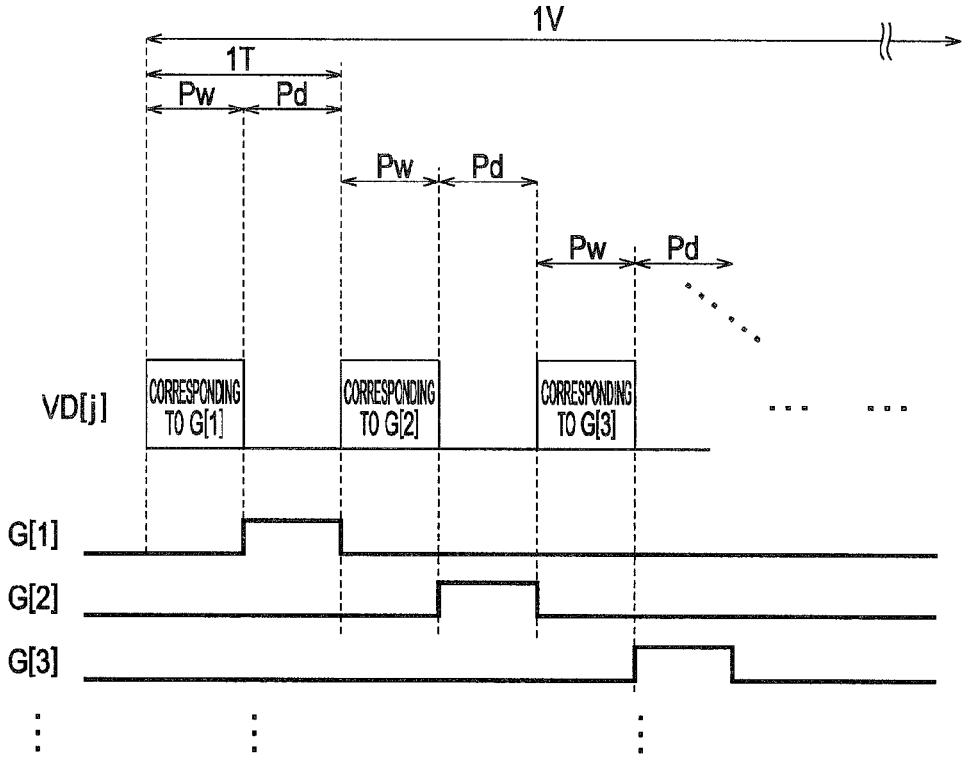
FIG. 7 is a timing chart for explaining an operation of the constitution of the comparative example in FIG. 6.

This is grasped more clearly by comparison between the first embodiment and FIG. 6, FIG. 7. Herein, FIG. 6 is the comparative example to the constitution of the first embodiment (refer to FIG. 2 comparatively), FIG. 7 is the timing chart regarding the operation of the constitution of the comparative example in FIG. 6 (refer to FIG. 3 comparatively).

In FIG. 6, unlike FIG. 1, FIG. 2 or the like, a scanning line 3Conv is provided by one corresponding to each row of the unit circuit P1. In short, in the first embodiment, a scanning line 3 corresponding to each row severally includes the two wirings 3_O and 3_E, whereas only one wiring exists in the comparative example.

With such a constitution in FIG. 6, the writing period Pw and the light emission period Pd appear accurately and alternately as shown in FIG. 7. Specifically, after performing a writing operation for the electric optical element 8 that belongs to the first row, an operation comes firstly, a light-emitting operation for the electric optical element 8 is performed secondly. Then, thirdly, a writing operation for the electric optical element 8 that belongs to second row is performed.

Then, in FIG. 6 and FIG. 7, when an attempt is made to perform a writing operation for the electric optical element 8 that belongs to a certain row, the data potential VD[j] is supplied to all data lines 6 simultaneously (more specifically, charging to all capacitative elements C1 is simultaneously performed), and when an attempt is made to perform a light-emitting operation for the electric optical element 8, discharging to all capacitative elements C1 is simultaneously performed. In short, at each point of the simultaneous charging or simultaneous discharging, fear that an extremely large current is instantaneously generated is large.

As it is obvious from the comparison above, according to the first embodiment, fear that the large current is generated extremely low. Therefore, in the first embodiment, various risks such as the one that noise associated with the current is generated, a risk that properly controlled operation regarding all unit circuits P1 becomes difficult due to the noise, or fear that adverse effect or the like to peripheral apparatus due to radiation of the noise is extremely reduced.

Second Embodiment

In the following, the second embodiment according to an aspect of the invention will be explained referring to FIG. 8 and FIG. 9. Note that, in the second embodiment, wirings included in the scanning line 3 are three, and a data potential generating section exists so as to correspond to each data line 6, and the second embodiment has the same constitution, operation and action or the like as the first embodiment for other points. Therefore, in the following, the different points will be mainly explained, and explanation for other points will be appropriately simplified or omitted.

Figure 8:
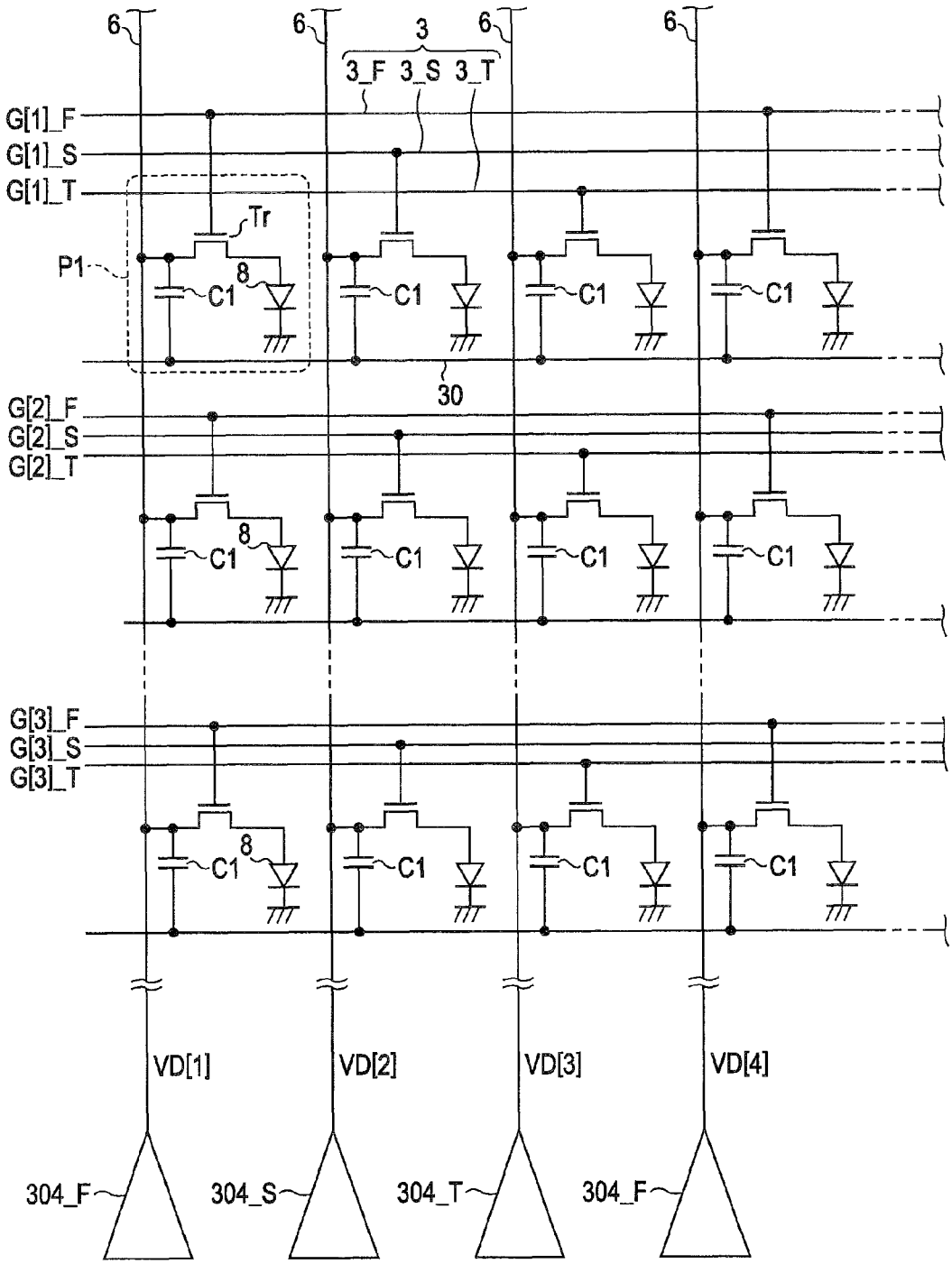
FIG. 8 is a circuit diagram showing details around unit circuits and data potential generating sections that constitute the electro-optical device according to the second embodiment of the invention.

In the second embodiment, firstly, as shown in FIG. 8, three wirings 3_F, 3_S and 3_T are included in one scanning line 3. Corresponding to this, the scanning line drive circuit 200 creates scan signals G[1]_F to G[m]_T which sequentially become active and outputs them to the 3m-pieces of wirings 3_F, 3_S and 3_T.

Further, in the second embodiment, the gate of the transistor Tr included in each unit circuit P1 is connected as follows. Firstly, the gate of the transistor Tr, which is included in a unit circuit P1 positioned on the first column, fourth column, . . . , (1+3z)th column, . . . , is connected to the wiring 3_F that constitutes the scanning line 3. Secondly, the gate of the transistor Tr, which is included in a unit circuit P1 positioned on the second column, fifth column, . . . , (2+3z)th column, . . . , is connected to the wiring 3_S that constitutes the scanning line 3. Thirdly, the gate of the transistor Tr, which is included in a unit circuit P1 positioned on the third column, sixth column, . . . , (3+3z)th column, . . . is connected to the wiring 3_T that constitutes the scanning line 3 (in the above, z=0, 1, 2, . . . . However, z satisfies 3+3z≤m). Meanwhile, in the following, the three types of unit circuits P1 above may be referred to as a unit circuit P1 of a first group, a unit circuit P1 of a second group, and a unit circuit P1 of a third group.

On the other hand, in the second embodiment, as shown in FIG. 8, the data line drive circuit 300 includes a data potential generating section 304 corresponding to each data line 6. The data potential generating section 304 mentioned here can be grouped into the data potential generating sections 304_F, 304_S and 304_T (refer to FIG. 8) corresponding to all unit circuits P1 that are grouped into the first to third groups of the unit circuits P1 as mentioned above. Specifically, the data potential generating section 304_F solely generates/supplies the data potential VD[1], VD[4], . . . , VD[1+3z], . . . for the unit circuit P1 of the first group connected to the wiring 3_F. Similarly, the data potential generating sections 304_S and 304_T solely generate/supply data potential VD[2+3z] and VD[3+3z] for the unit circuits P1 of the second and third groups connected to the wirings 3_S and 3_T, respectively.

Note that, the data potential generating section 304 falls under one specific example of the "data potential generating section" in the invention. Further, this Specification uses the reference numeral "304" as a reference numeral that collectively calls the reference numerals "304_F", "304_S" and "304_T".

The electro-optical device according to the second embodiment equipped with such a constitution operates or acts as follows. Firstly, in the writing period Pw shown on the far left side of FIG. 9, the data potential generating section 304_F in the data line drive circuit 300 creates a data potential VD[1+3z], and supplies it to a corresponding data line 6 (i. writing operation above). The data potential VD[1+3z] corresponds to the electric optical element 8 in a unit circuit P1 positioned on the first row and a unit circuit P1 of the first group (in FIG. 9, refer to items "Corresponding to G[1]_F").

Subsequently, in the second embodiment, in the writing period Pw, the writing operation for the electric optical element 8 in a unit circuit P1 positioned on the first row and a unit circuit P1 of the second group is also performed in parallel. Specifically, as shown in FIG. 9, the writing operation starts at the point where approximately half of the writing period Pw for the first group ended (in FIG. 9, refer to the items "Corresponding to G[1]_S"). The essence of the operation in this case is not different from the case of the above-mentioned writing operation for the first row. However, in this case, the data potential generating section 304_S in the data line drive circuit 300 creates the data potential VD[2+3z], and supplies it to a corresponding data line 6.

The reason why such an operation is possible is that the data potential generating sections 304_F and 304_S are provided individually for each data line 6.

Consequently, the data potential VD[1] corresponding to the electric optical element 8 of the first row and first column, for example, is held by the capacitative elements C1 in all unit circuits P1 included in the first column. On the other hand, the data potential VD[2] corresponding to the electric optical element 8 of the first row and second column is held by the capacitative elements C1 in all unit circuits P1 included in the second column.

Subsequently, in a driving period Pd adjacent to the above-mentioned writing period Pw for the unit circuit P1 of the first row and first group, the scanning line drive circuit 200 supplies an active-state scan signal G[1]_F to the wiring 3_F included in the scanning line 3 on the first row. Thus, electric optical elements 8 that belong to the unit circuit P1 positioned on the first row and the unit circuit P1 of the first group emit light simultaneously (ii. light-emitting operation). In this case, a current flowing in the electric optical elements 8 corresponds to a charge amount accumulated in the capacitative elements C1 that belong to the above-mentioned first column. Consequently, one unit period 1T ends (refer to top areas of FIG. 9).

Meanwhile, in this case, the above-mentioned writing period Pw for the first row and second groups still continues. In short, the light-emitting operation for the first group and the writing operation for the second group are performed in parallel.

After this, although there is a difference in wirings or data potential generating sections to be involved such as the wiring 3_F, 3_S and 3_T and the data potential generating sections 304_F, 304_S and 304_T, the same operation as the one described above will be performed repeatedly (refer to FIG. 9).

It is evident that an operational effect that is not substantially different from the operational effect exerted by the first embodiment is exerted by the above-described second embodiment.

Moreover, according to the second embodiment, since the data potential generating section 304 for each data line is equipped, the writing operation for the capacitative elements C1 that belong to the unit circuits P1 of the first and second, the second and third, or the first and third groups can be performed in parallel as described the above. Specifically, comparing this operation with the fact that the writing operation for an odd-numbered column and a light-emitting operation for an even-numbered column (or its opposite) can be performed in parallel in the first embodiment, time usage is more efficient in the second embodiment. Actually in FIG. 9, it turns out that a longer writing period than FIG. 3 is realized by utilizing this.

As described, according to the second embodiment, an operational effect better than the operational effect exerted by the first embodiment could be exerted.

Further, in the second embodiment, as comparison between FIG. 8 and FIG. 2 shows, the first and second switching transistors 302_O and 302_E and the wirings for SW 303_O and 303_E, which are installed in the first embodiment, are not necessary. Therefore, according to the second embodiment, cost reduction required for installing these parts is expected. Further, control or the like of the first and second switching transistors 302_O and 302_E through the wirings for SW 303_O and 303_E is also not necessary, so that a simplified operation sequence or the like can be realized as well.

The embodiments according to the invention have been explained above, the electro-optical device and pixel circuit according to the invention are not limited to the above-described embodiments, but various modifications can be made.

1. In the first and second embodiments, a subject to be charged in i. writing operation mentioned above is the capacitative element C1 included in the unit circuit P1, but the invention is not limited to such.

Figure 10:
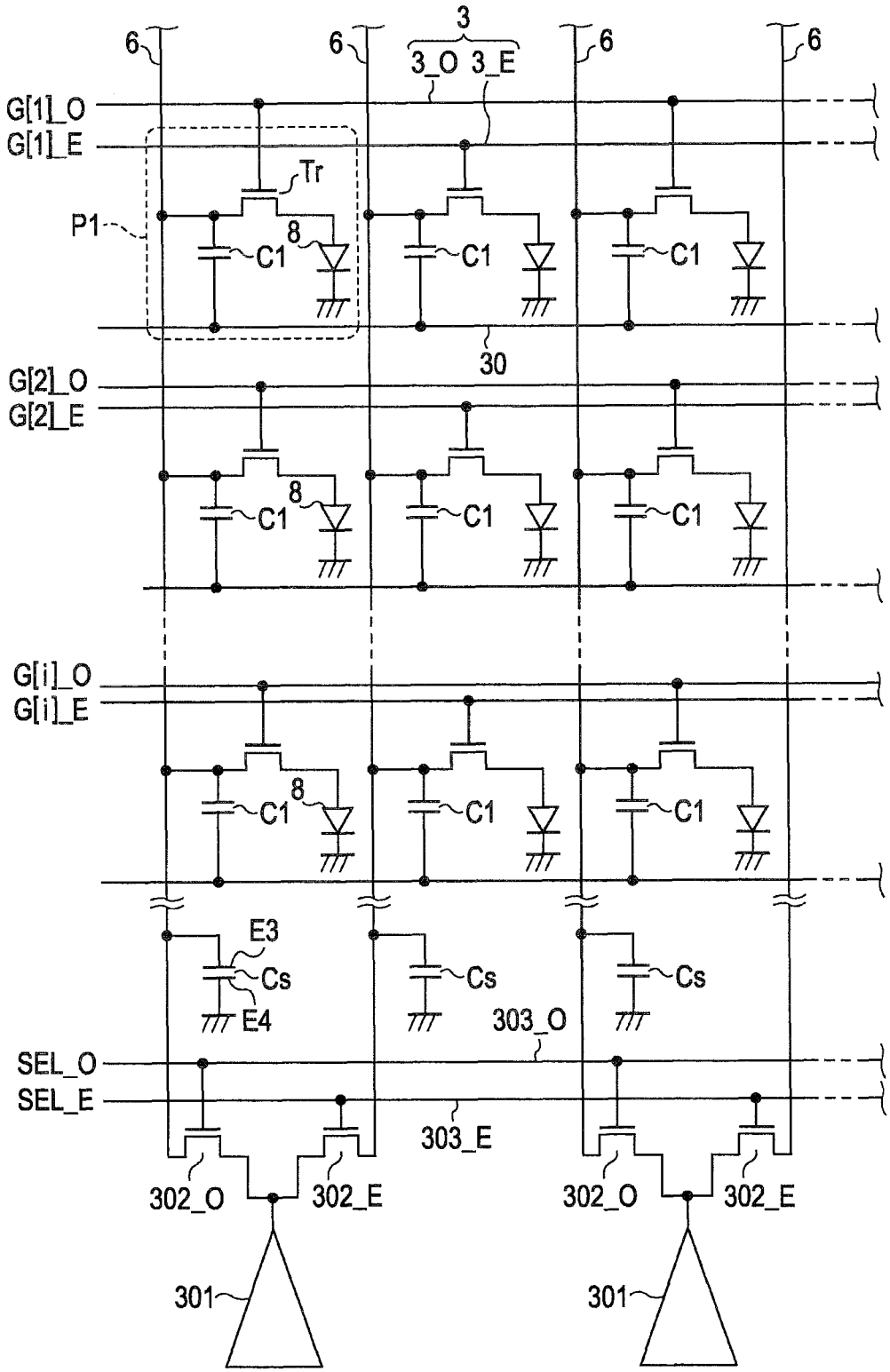
FIG. 10 is a circuit diagram showing details around unit circuits and data potential generating sections that constitute a modified example (addition of an auxiliary capacitative element) of the electro-optical device according to the first and second embodiments of the invention.

For example, as shown in FIG. 10, an auxiliary capacitative element Cs may be connected to the data line 6. In the capacitative element Cs, one electrode E3 is connected to the data line 6 and the other electrode E4 is connected to a potential line to which a fixed potential is supplied. Meanwhile, although FIG. 10 illustrates where the capacitative element Cs is added to the constitution of FIG. 2 while using the first embodiment as a premise, it goes without saying that where the capacitative element Cs is added while using FIG. 8 for the second embodiment as a premise.

Figure 9:
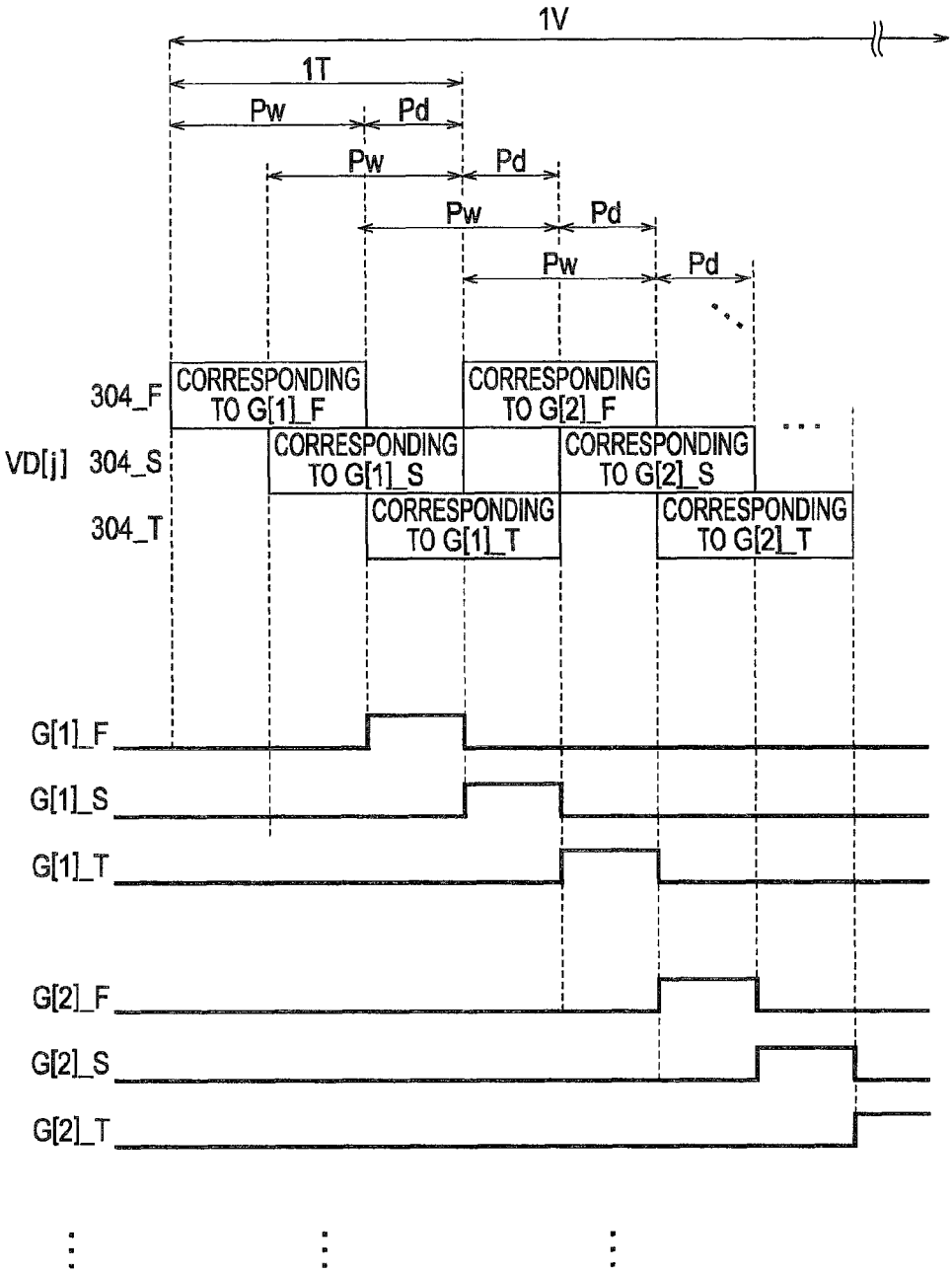
FIG. 9 is a timing chart for explaining an operation of the electro-optical device in FIG. 8.

In such, in the writing period Pw in each unit period 1T shown in FIG. 3 or FIG. 9, the auxiliary capacitative element Cs is also charged in addition to a predetermined capacitative element C1. Further, in the driving period Pd in each unit period 1T shown in each drawing, charge from the auxiliary capacitative element Cs is supplied to a unit circuit P1 corresponding to the auxiliary capacitative element Cs.

According to such, even if a total capacitance value of the capacitative elements C1 connected to a data line 6 corresponding to one electric optical elements 8 is insufficient to make a light emission amount of the electric optical element 8 be a sufficient value, the shortage can be compensated by using a capacitance of the auxiliary capacitative element Cs.

2. In the first and second embodiment, where the capacitative element C1 is included in the unit circuit P1 is explained, but the invention is not limited to such.

Figure 11:
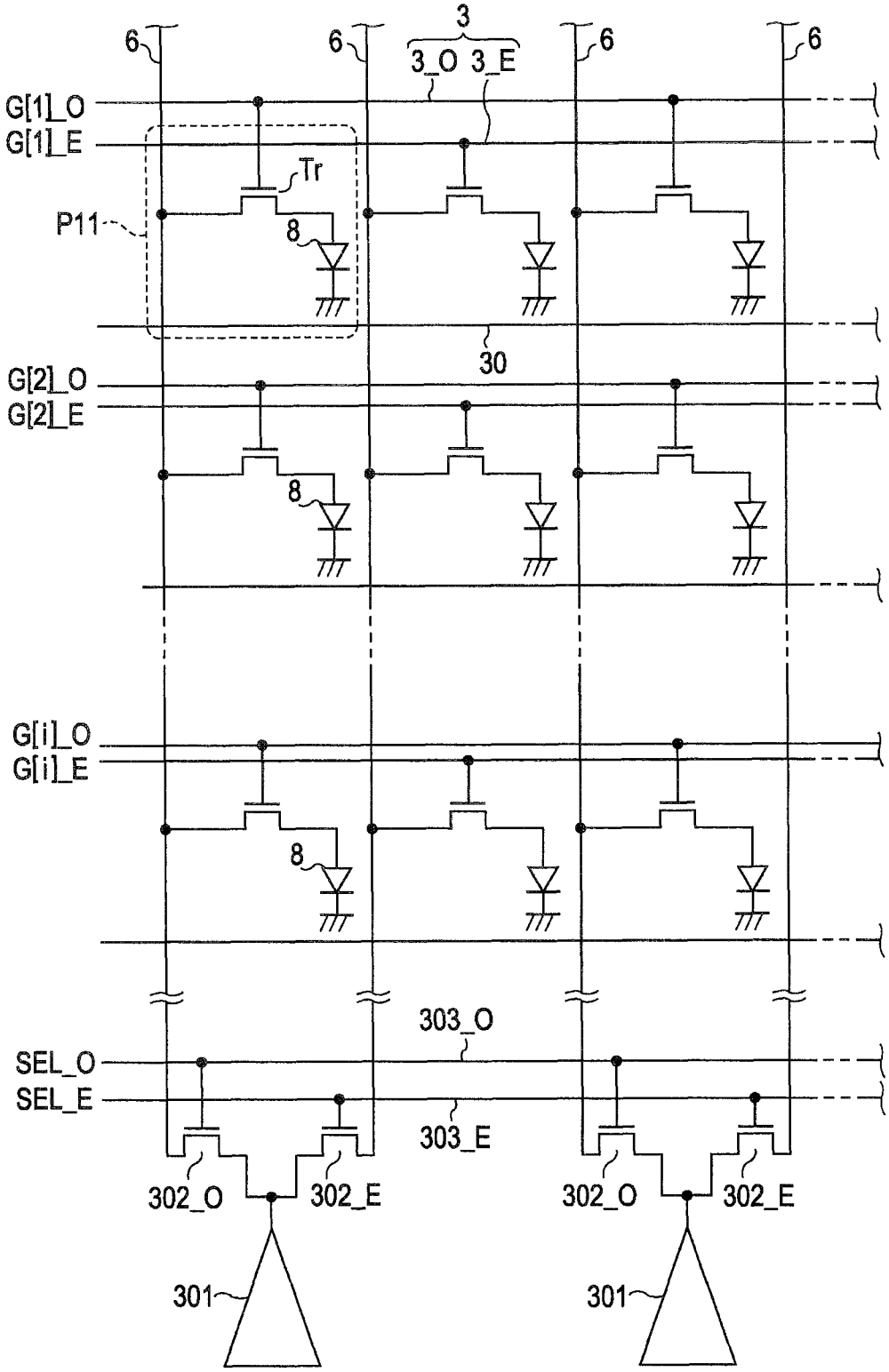
FIG. 11 is a circuit diagram showing details around unit circuits and data potential generating sections that constitute a modified example (no existence of a capacitative element) of the electro-optical device according to the first and second embodiment of the invention.

For example, as shown in FIG. 11, a unit circuit P11 needs not include the capacitative elements C1 in each of the embodiments. In this case, charge in response to the data potential VD[j] is stored in capacitance attached to each data line 6, more specifically, parasitic capacitance that is parasitic between the data line 6 and the anode of the electric optical element 8 or the like, for example.

According to such, cost reduction required for installing the above-mentioned capacitative element C1 can be achieved. Further, due to the same reason, size reduction of the unit circuit P11 can be also realized, so that higher definition is made possible.

Meanwhile, an aspect where the auxiliary capacitative element Cs, which was explained referring to FIG. 10, is added to the aspect shown in FIG. 11 is naturally within the scope of the invention.

3 . In the second embodiment, an aspect where one scanning line 3 includes the three wiring 3_F, 3_S and 3_T, and the data potential generating section 304 corresponding to each data line 6 is equipped is explained, these two matters are independent to each other. In short, if the first embodiment is used as a reference, an aspect where the data potential generating section 304 corresponding to each data line 6 is merely added instead of a data potential generating section 301 or the like that constitutes the aspect is naturally within the scope of the invention. Further, an aspect where additional three or more of wirings are merely added to each scanning line 3 of the first embodiment is within the scope of the invention.

4. In each embodiment, one each of the data line 6 is provided for each column of unit circuit P1, the invention is not limited to such an aspect. For example, in each embodiment, as one scanning line 3 has a plurality of wirings, the data line 6 may also have a plurality of wirings. Then, in this case, for example, an aspect where a unit circuit P1 positioned on an odd-numbered row is connected to one wiring out of the plurality of wirings and a unit circuit P1 positioned on an even-numbered row is connected to another wiring is possible as a variation of a specific mode of the invention. With this variation, in one opportunity, a capacitative element C1 being a subject of charging or discharging is a capacitative element C1 that belongs to a unit circuit P1 of the first group and is included in a unit circuit P1 positioned on an odd-numbered row, for example, the above-mentioned effect of preventing the generation of a large current may be achieved better.

Application

Next, electronic apparatus to which the electro-optical device 10 according to the embodiment is applied will be explained.

Figure 12:
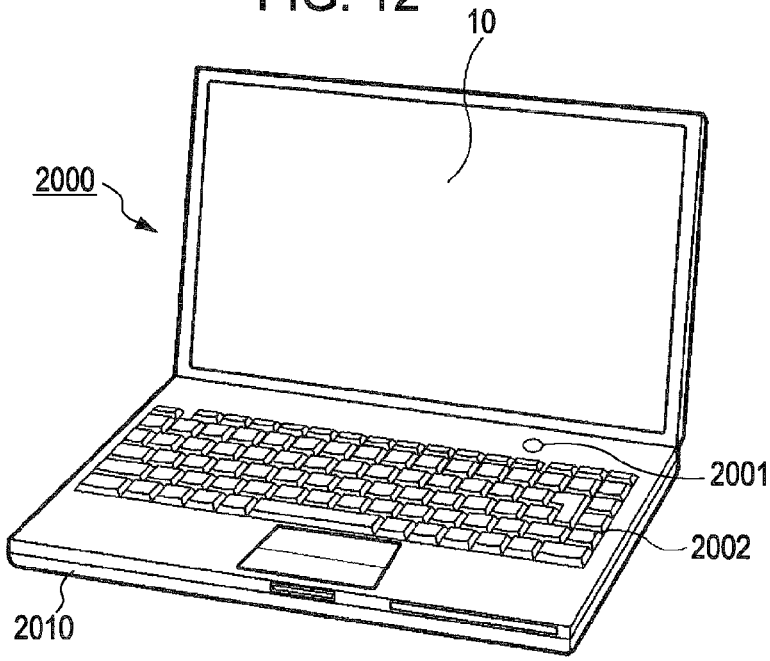
FIG. 12 is a perspective view showing an electronic apparatus to which the electro-optical device according to an aspect of the invention is applied.

FIG. 12 is a perspective view showing a constitution of a mobile personal computer in which the electro-optical device 10 according to the embodiment is utilized as an image display apparatus. A personal computer 2000 is equipped with the electro-optical device 10 as a display device and a main body section 2010. A power switch 2001 and a keyboard 2002 are provided for the main body section 2010.

Figure 13:
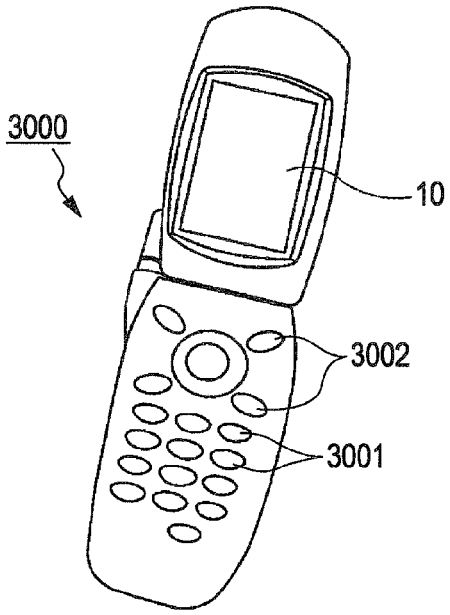
FIG. 13 is a perspective view showing another electronic apparatus to which the electro-optical device according to an aspect of the invention is applied.

FIG. 13 shows a cell phone to which the electro-optical device 10 according to the embodiment is applied. A cell phone 3000 is equipped with a plurality of operation buttons 3001, a scroll button 3002 and the electro-optical device 10 as a display device. By operating the scroll button 3002, a screen displayed on the electro-optical device 10 is scrolled.

Figure 14:
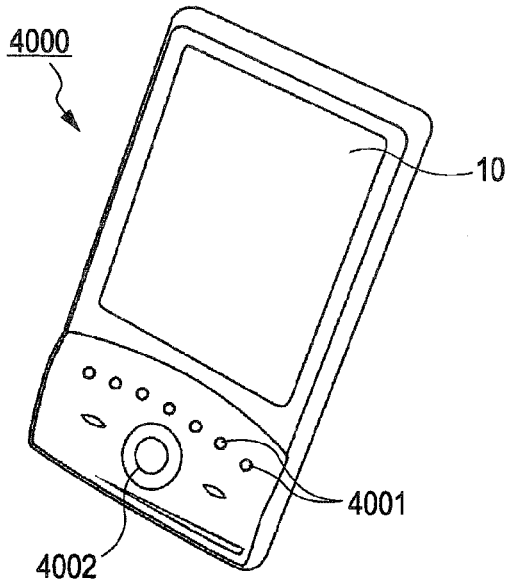
FIG. 14 is a perspective view showing still another electronic apparatus to which the electro-optical device according to an aspect of the invention is applied.

FIG. 14 shows a personal digital assistance (PDA: Personal Digital Assistant) to which the electro-optical device 10 according to the embodiment is applied. A personal digital assistance 4000 is equipped with a plurality of operation buttons 4001, a power switch 4002 and the electro-optical device 10 as a display device. When the power switch 4002 is operated, various information such as an address book and a schedule book is displayed on the electro-optical device 10.

As electronic apparatus to which the electro-optical device according to an aspect of the invention is applied, other than the ones shown in FIG. 12 to FIG. 14, a digital still camera, a television set, a video camera, a car navigation unit, a pager, an electronic notebook, an electronic paper, a calculator, a word processor, a workstation, a videophone, a POS terminal, a video player, a device equipped with a touch panel or the like are cited.

What is claimed is:

1. An electro-optical device, comprising:

a plurality of scanning lines, each scanning line including at least two or more wirings;

a plurality of data lines intersecting the scanning lines;

a plurality of unit circuits, each unit circuit:

being disposed at an intersection of one of the wirings of one of the scanning lines and one of the data lines, being connected to the one of the wirings and the one of the data lines, and corresponding to a unit period including a driving period and a writing period;

a data line drive circuit that outputs a plurality of data potentials to only some of the data lines, in response to gradation data of the corresponding unit circuits connected to the corresponding data line, during the first half of a unit period of a unit circuit, and outputs a plurality of data potentials to the other data lines during a second half of a unit period of each unit circuit; and a scanning line drive circuit that sequentially selects one of the wirings of one of the scanning lines during one of the driving periods of one of the unit circuits, wherein each of the plurality of unit circuits includes:

an electric optical element that displays gradation in response to the data potential; and a capacitative element having a first electrode and a second electrode; and a switching element that is electrically connected between the second electrode and the electric optical element, wherein the first electrode of the capacitative element is directly connected to a capacitance line without being connected to the switching element, and the second electrode of the capacitative element is directly connected to the data line, and wherein the capacitance line receives a fixed, non-grounding potential.

2. An electro-optical device according to claim 1, the electro-optical device further comprising:

a plurality of switching elements, each switching element being disposed between one of the data lines and the data line drive circuit, some of the switching elements and the other switching elements alternately entering an electrically conducting state during a unit period.

3. An electro-optical device according to claim 2, wherein during the electrically conducting state of each switching element, the data line is electrically conducted by the data line drive circuit causing charge corresponding to the data potential to accumulate in the capacitative element connected to the data line.

4. An electro-optical device, comprising:

a scanning line having a first wiring and a second wiring;

a first data line;

a second data line;

a scanning line drive circuit that supplies a first scanning signal to the first wiring and that supplies a second scanning signal to the second wiring;

a data line drive circuit that supplies a first data signal to the first data line and that supplies a second data signal to the second data line;

a first electric optical element;

a first capacitative element having a first electrode and a second electrode, the first capacitative element holding the first data signal;

a first switching element that controls a first conduction state between a first end and a second end according to the first scanning signal;

a second electric optical element;

a second capacitative element having a third electrode connected to the capacitance line and a fourth electrode directly connected to the second data line, the second capacitative element holding the second data signal; and a second switching element that controls a second conduction state between a third end and a fourth end according to the second scanning signal, the first end of the first switching element being directly connected to the second electrode of the first capacitative element, the second end of the first switching element being electrically connected to the first electric optical element, the third end of the second switching element being directly connected to the fourth electrode of the second capacitative element, the fourth end of the second switching element being electrically connected to the second electric optical element, wherein the first electrode of the capacitative element is directly connected to a capacitance line without being connected to the first and the second switching elements, and the second electrode of the capacitative element is directly connected to the data line, and wherein the capacitance line receives a fixed, non-grounding potential.

5. The electro-optical device according to claim 4, the data line drive circuit supplying the second data signal to the second data line in a first period when the second electrode of the first capacitative element is electrically connected to the first electric optical element.

6. The electro-optical device according to claim 4, wherein the data line drive circuit includes a switching section that supplies the first data signal to the first data line in a first period and that supplies the second data signal to the second data line in a second period after the first period.

7. The electro-optical device according to claim 4, wherein the data line drive circuit includes a first generating section that supplies the first data signal to the first data line and a second generating section that supplies the second data signal to the second data line, the first generating section and the second generating section being operated independently from each other.

8. The electro-optical device according to claim 4, further comprising:

a third capacitative element having one electrode connected to the first data line.

9. Electronic apparatus, comprising:

the electro-optical device according to claim 4.

10. An electro-optical device, comprising:

a scanning line having a first wiring and a second wiring;

a first data line;

a second data line;

a scanning line drive circuit that supplies a first scanning signal to the first wiring and that supplies a second scanning signal to the second wiring;

a first switching element;

a second switching element;

a data line drive circuit that supplies a first data signal through the first switching element to the first data line and that supplies a second data signal through the second switching element to the second data line;

a first electric optical element;

a third switching element that controls a first conduction state between a first end and a second end according to the first scanning signal;

a second electric optical element;

a fourth switching element that controls a second conduction state between a third end and a fourth end according to the second scanning signal, the first end of the third switching element being directly connected to the first data line, the second end of the third switching element being electrically connected to the first electric optical element, the third end of the fourth switching element being directly connected to the second data line, the fourth end of the fourth switching element being electrically connected to the second electric optical element; and a capacitative element having a first electrode and a second electrode, wherein the first electrode of the capacitative element is directly connected to a capacitance line without being connected to the first and the second switching elements, and the second electrode of the capacitative element is directly connected to the data line, and wherein the capacitance line receives a fixed, non-grounding potential.

11. The electro-optical device according to claim 10, the data line drive circuit supplying the second data signal through the second switching element to the second data line in a first period when the second electrode of the first capacitative element is electrically connected to the first electric optical element.

12. The electro-optical device according to claim 10, wherein the data line drive circuit includes a switching section that supplies the first data signal to the first data line in a first period and that supplies the second data signal to the second data line in a second period after the first period.

13. The electro-optical device according to claim 10, wherein the data line drive circuit includes a first generating section that supplies the first data signal to the first data line and a second generating section that supplies the second data signal to the second data line, the first generating section and the second generating section being operated independently from each other.

14. The electro-optical device according to claim 10, further comprising:

a second capacitative element having one electrode connected to the first data line.

15. Electronic apparatus, comprising:

the electro-optical device according to claim 10.

* * * * *